US007124727B2

(12) United States Patent
Kogawa et al.

(10) Patent No.: US 7,124,727 B2
(45) Date of Patent: Oct. 24, 2006

(54) INSTALLATION STRUCTURE OF INTAKE MANIFOLD

(75) Inventors: Youichi Kogawa, Nagoya (JP); Masatoshi Hada, Nagoya (JP)

(73) Assignee: Aichi Kikai Kogyo Kabushiki Kaisha, Aichi (JP)

( * ) Notice: Subject to any disclaimer, the term of this patent is extended or adjusted under 35 U.S.C. 154(b) by 0 days.

(21) Appl. No.: 10/528,338

(22) PCT Filed: Nov. 13, 2003

(86) PCT No.: PCT/JP03/14487

§ 371 (c)(1),
(2), (4) Date: Mar. 18, 2005

(87) PCT Pub. No.: WO2004/046536

PCT Pub. Date: Jun. 3, 2004

(65) Prior Publication Data

US 2006/0016414 A1 Jan. 26, 2006

(30) Foreign Application Priority Data

Nov. 20, 2002 (JP) ..... 2002-337316

(51) Int. Cl.
*F02B 75/22* (2006.01)
*F02M 35/10* (2006.01)

(52) U.S. Cl. ..... 123/195 R; 123/184.21

(58) Field of Classification Search ..... 123/184.21, 123/195 R, 184.42
See application file for complete search history.

(56) References Cited

FOREIGN PATENT DOCUMENTS

| | | |
|---|---|---|
| JP | 59-043923 | 3/1984 |
| JP | 61-178030 | 11/1986 |
| JP | 62-160770 | 10/1987 |

*Primary Examiner*—Noah P. Kamen
(74) *Attorney, Agent, or Firm*—Dennison, Schultz & MacDonald

(57) ABSTRACT

In an intake manifold 3 having a plurality of branch tubes 4, 4 arranged over the top surface of a cylinder head 1 in a state were a flange 7 provided at downstream-side ends of the branch tubes 4, 4 is fixed to a lateral surface of the cylinder head 1, and having a plenum chamber portion 5 provided at upstream-side ends of the branch tubes 4, 4, a retainer 10 is provided on the lateral surface of the cylinder head 1 and projecting outward therefrom, and an engaging recess 9 is provided in the lower portion of the flange 7 in order to engage with the retainer 10. Further, in the plenum chamber portion 5 of the intake manifold 3, flat portions 8, 8 are formed and are permitted to be provisionally placed on and fixed in position relative to the top surface of a rocker cover 2.

6 Claims, 21 Drawing Sheets

INSTALLATION STRUCTURE OF INTAKE MANIFOLD

The present invention relates to a mounting structure of an intake manifold.

This application is a filing under 35 USC 371 of PCT/JP2003/014487 filed Nov. 13, 2003.

PRIOR ART

Conventionally, an intake manifold is mounted on a cylinder head, as shown by the perspective view FIG. 11, by the side view in FIG. 12, and by the plan view in FIG. 13.

The intake manifold 3 has a plurality of branch tubes 4 that have a plenum chamber portion 5 at their upstream-side ends. A throttle chamber mounting flange 6 is mounted to a lateral surface of the plenum chamber portion 5. A flange 7 is mounted to downstream-side ends of the branch tubes 4. This flange 7 is fixedly mounted to the lateral surface of the cylinder head 1 via a flange mounting bolt 15.

A rocker cover 2 is provided on the top of the cylinder head 1. In the mounted state, the branch tubes 4 extend from the lateral surface of the cylinder head 1 over the rocker cover 2, and the plenum chamber portion 5 is supported by a vertical intake-manifold support 51 that extends vertically from the lateral surface on the opposite side of the cylinder head 1.

This arrangement of the intake manifold 3 having the branch tubes 4, 4 extending over the rocker cover 2 has such an advantage that the size of an engine in the direction perpendicular to the direction of the arrangement of the cylinders can be made smaller, so that it has been adopted in many cases.

Besides, the intake manifold 3 made of synthetic resin is adopted in many cases because of light weight and excellent moldability. However, in the case of a resin-made intake manifold, there is a possibility that the flange 7 may cause defective sealing due to secular change of the resin such as creep deformation after tightening the flange 7. Accordingly, in order to prevent the defective sealing, the mounting structure of the flange 7 to the cylinder head 1 as shown in FIG. 14 is adopted. Namely, at the joining surface between the flange 7 and the flange 1*a* of the cylinder head 1, O-ring grooves 7*b*, 7*b*, 7*b* are formed, and an O-ring 50 is fitted into each O-ring groove 7*b*. The O-ring 50 is shown by the enlarged sectional view in FIG. 15.

However, in the structure where the branch tubes 4 are arranged over the rocker cover 2 as shown in FIG. 11, the branch tubes 4, 4, 4 substantially conceal the flange 7, so that it brings unsatisfactory visibility of the position of the bolt holes 7*a*, 7*a*, 7*a* that are formed in the flange 7 in order to receive the fitting bolts 15. Accordingly, the positions of the bolt holes 7*a*, 7*a*, 7*a* of the flange 7 may not align with the positions of the bolt holes of the flange 1*a* on the cylinder head 1, so that the positioning operation for the fitting bolt holes 7*a*, 7*a* becomes difficult. Therefore, in the state that O-ring 50 is fitted in the O-ring groove 7*b*, the flange 7 is slid and moved on the flange 1*a* of the cylinder head 1 for positioning. As a result, a problem arises that the O-ring 50 is liable to drop out or suffer damage and to cause a defective sealing.

In order to solve this problem, there has been proposed to perform the positioning by making use of two stud bolts 52, 52, as shown by the perspective view in FIG. 16, by the side view in FIG. 17, and by the plan view in FIG. 18.

Namely, as shown in the enlarged view of FIG. 20, stud bolts 52 are planted in advance in two positions corresponding to the bolt hole of the flange 1a of the cylinder head 1. The fitting bolt holes 7*a*, 7*a* of the flange 7 on the intake manifold 3 are inserted into these stud bolts 52, 52. Accordingly, the satisfactory positioning can be performed, so that it is possible to prevent O-rings from dropping out.

However, as shown in FIG. 20, the stud bolt 52 requires to ensure outward projection length L that is the sum of thickness H1 of flange 7, thickness H2 of nut 53, thickness t1 of washer 54 and engaging margin S of nut 53.

When the fitting bolt holes 7*a*, 7*a* of the flange 7 are inserted to the stud bolts 52 projected outward by length L, it is necessary to arrange the flange 7 outside beyond the terminal end of the projection length L of the stud bolt 52, and to move the flange 7 toward the cylinder head 1, as shown by the side view in FIG. 19. Accordingly, there is a problem that the layout around the cylinder head is restricted to ensure no interfering object within the space for moving the flange 7.

Alternatively, as shown in FIG. 21, in case the plenum chamber portion is disposed outside the cylinder arrangement, the rocker cover 2 interferes the plenum chamber portion 5, so that a satisfactory space for moving the flange 7 to suit the stud bolt 52 can not be obtained. Namely, the plenum chamber portion 5 comes in contact with the rocker cover 2, so that it becomes impossible to move the flange 7 by the projection length L of the stud bolt 52.

To work out this difficulty, as shown in FIG. 22, it is necessary to make a structure in which the branch tube 4 is divided into sections 4*a* and 4*b* and connected at the joint 40. However, there arises a problem that the structure becomes complicated.

SUMMARY OF THE INVENTION

It is an object of the present invention to provide a mounting structure of an intake manifold in which the positioning of the flange of the intake manifold is easy and the fitting bolts are efficiently fitted without requiring stud bolts or other jigs, etc.

In order to achieve the above object, according to the present invention, there is provided an intake manifold having a plurality of branch tubes arranged over the top surface of a cylinder head in the state where a flange provided at the downstream-side ends of the branch tubes is fixed to a lateral surface of the cylinder head, and having a plenum chamber portion provided at the upstream-side ends of the branch tubes, An outwardly projecting arm is provided on the lateral surface of the cylinder head and an engaging recess is formed in the lower portion of the flange for engaging with the projecting arm.

According to the present invention, when the flange of the intake manifold is mounted on the lateral surface of the cylinder head, it is possible that the engaging recess of the flange is engaged with the projecting arm of the retainer and the flange is provisionally placed on the projecting arm. Then, the flange can be moved toward the cylinder head to accurately position the bolt holes. Since the positioning operation can be easily performed without causing the O-rings to be dropped, it is possible to secure good sealing for the flange of the intake manifold.

Moreover, it is not necessary to use the conventional stud bolts, so that it is possible to reduce the number of part items.

According to an embodiment of the present invention, the projecting arm is formed to be tapered from the wide base portion for engaging with the engaging recess to the tip end narrower than the engaging recess.

With this embodiment, for the first, the engaging recess of the flange is provisionally placed on the tip end of the projecting arm, and then the flange can be gradually moved toward the base of the projecting arm. Since the condition where the engaging recess is fitted in the base portion of the projecting arm results in the accurate positioning of the bolt holes, the intake manifold can be easily mounted independently of worker's skill and the like, preventing O-ring from dropping out, and enhancing the reliability.

Further, according to another embodiment of the present invention, the tip end of the projecting arm is formed as an upwardly inclined end portion.

With this embodiment, once the flange of the intake manifold is provisionally placed on the projecting arm, the flange moves by itself due to its own weight without coming off the projecting arm because the tip end of the arm is formed as the upwardly inclined configuration.

Still further, according to another embodiment of the present invention, the plenum chamber portion of the branch tubes is provided with flat portions adapted to be provisionally placed on and fixed to the top surface of the cylinder head.

With this embodiment, the plenum chamber portion having a heavy weight can be provisionally placed on the top surface of the cylinder head by the flat portions, so that the mounting operation of the intake manifold becomes easy. Besides, since the flat portion of the plenum chamber is fixed to the top surface of the cylinder head, the mounting strength of the intake manifold can be ensured. As a result, any reinforced intake-manifold support and the like in the prior art are not required.

PREFERRED EMBODIMENTS OF THE INVENTION

Hereinafter, embodiments of the present invention will be described with reference to the drawings.

Figure 1:
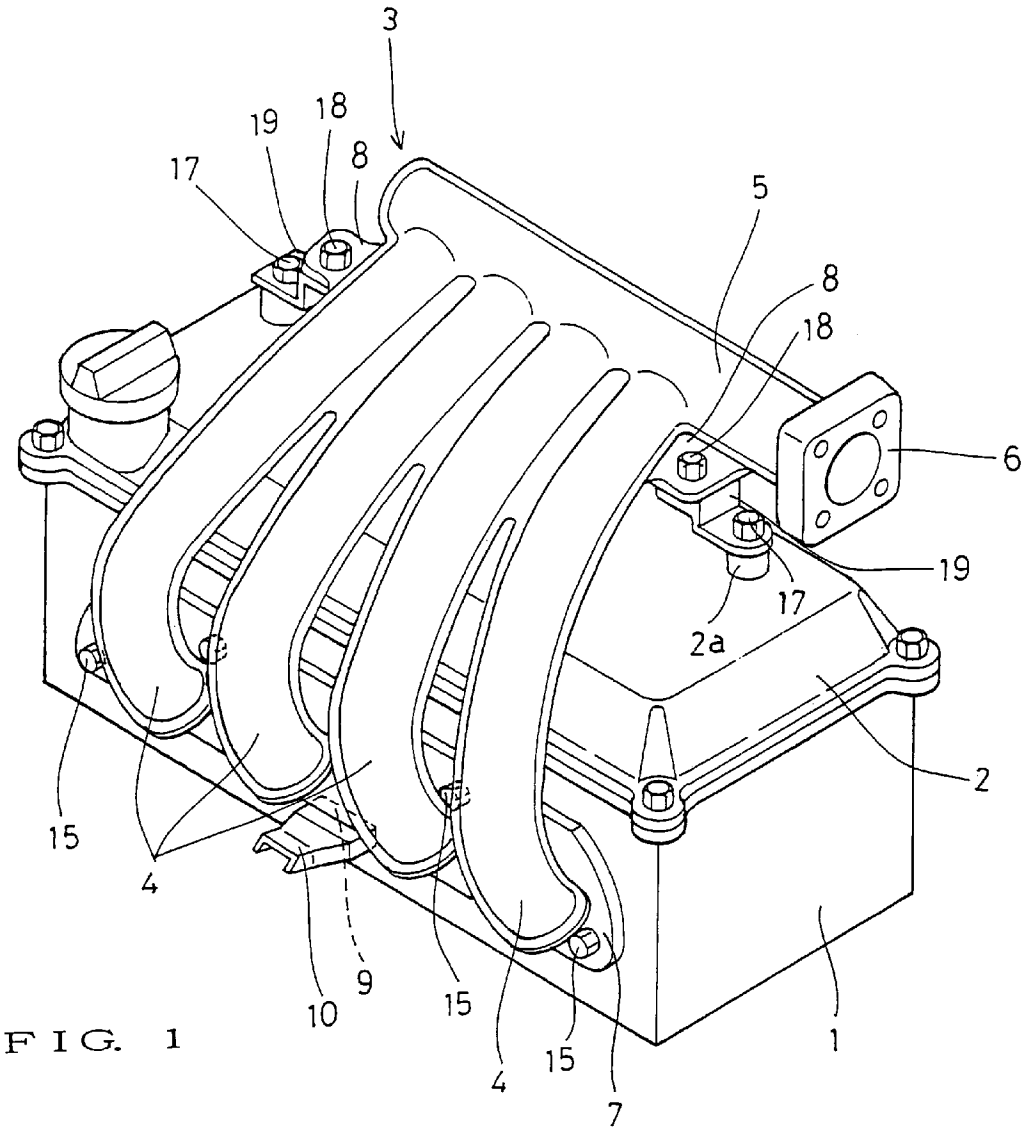
FIG. 1 is a perspective view of the mounting structure of an intake manifold according to a first embodiment of the present invention.
Figure 2:
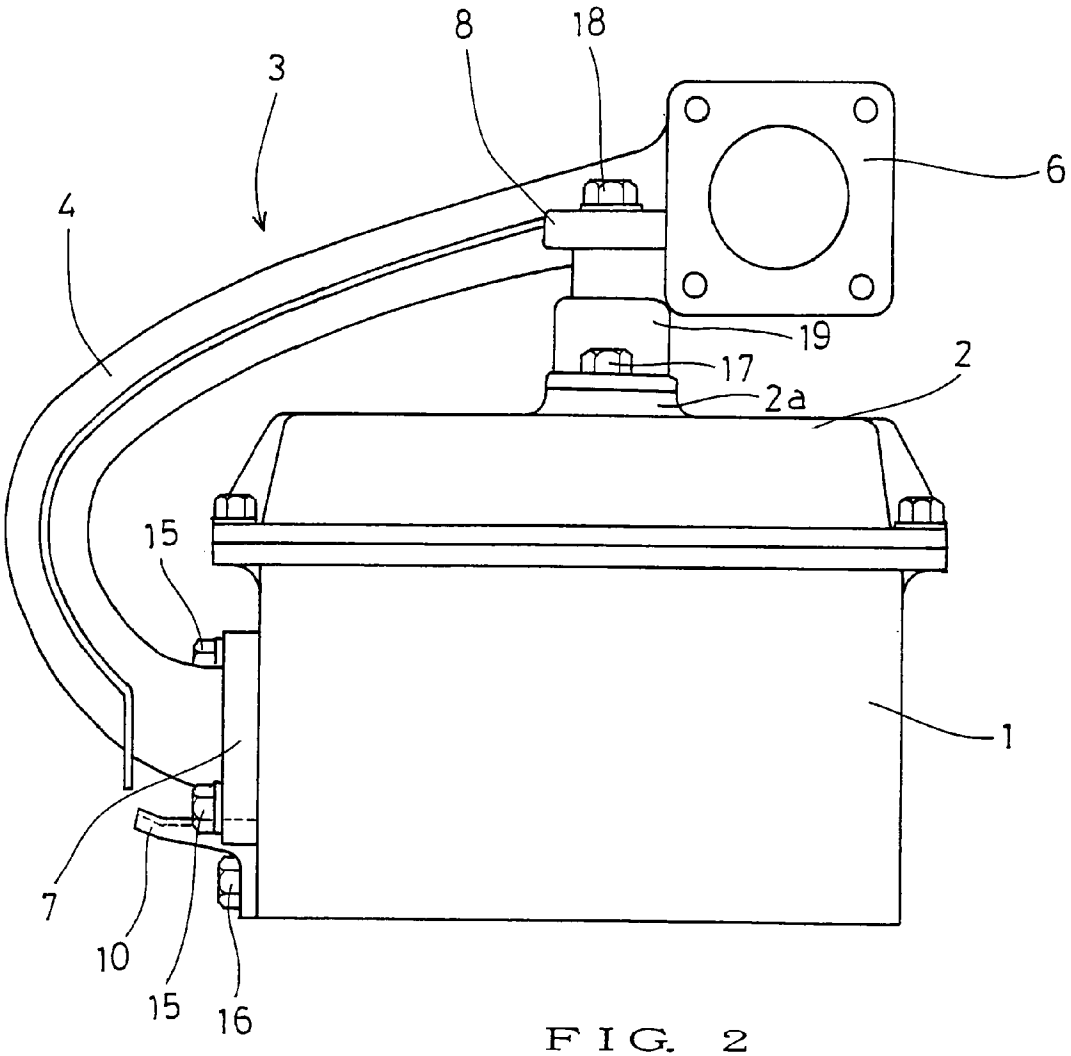
FIG. 2 is a side view of FIG. 1.
Figure 3:
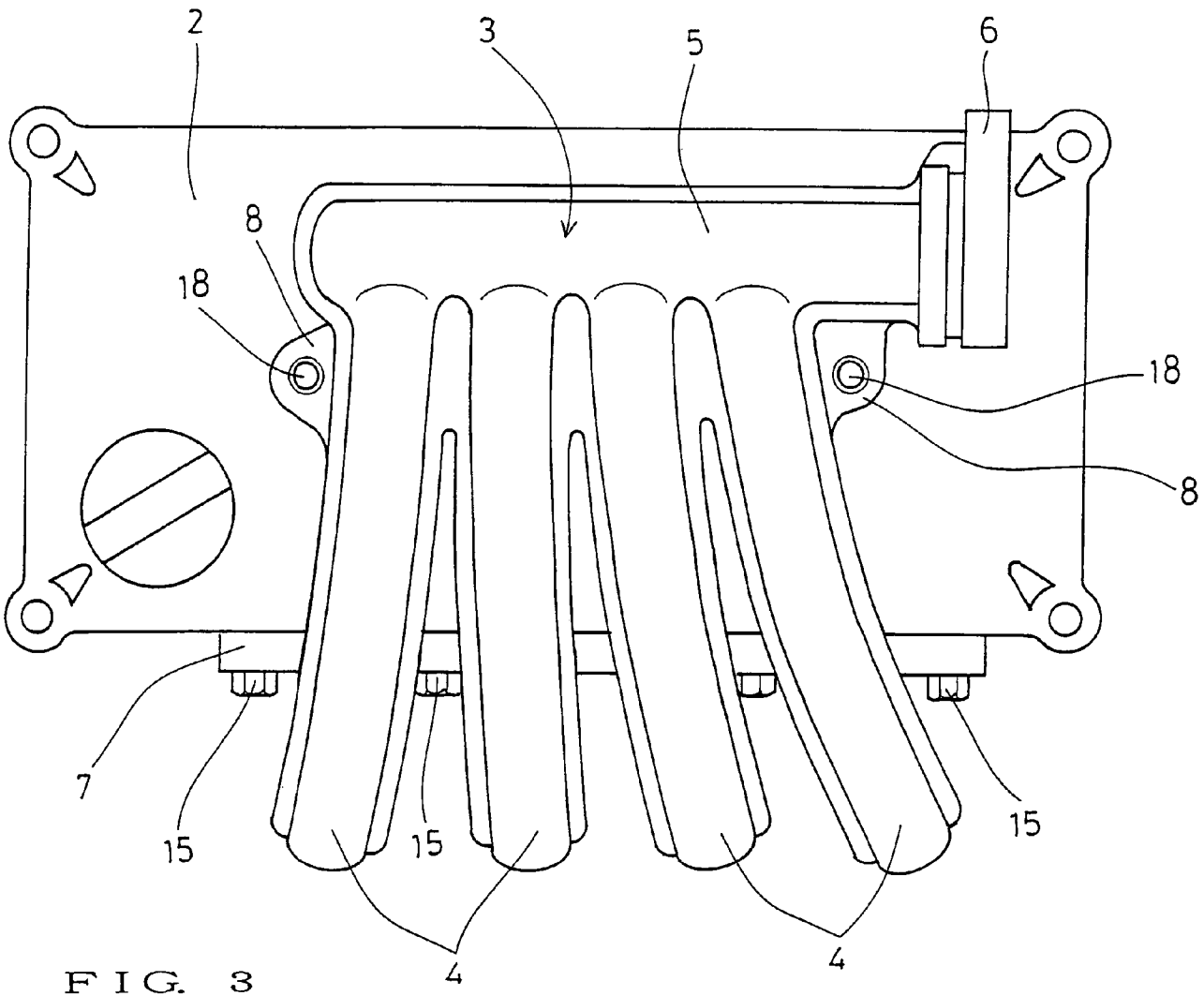
FIG. 3 is a plan view of FIG. 1.

FIG. 1 is a perspective view of a mounting structure of an intake manifold mounted on a cylinder head. FIG. 2 is a side view, and FIG. 3 is a plan view of the same.

In the drawings, the top surface of a cylinder head 1 is covered with a rocker cover 2, and an intake manifold 3 is mounted on the lateral side of the cylinder head 1 via a flange 7.

The intake manifold 3 includes four branch tubes 4 having upstream-side ends to which the flange 7 is mounted. On the upstream-side ends of the branch tubes 4, there is provided a plenum chamber portion 5 having the right end to which a throttle chamber mounting flange 6 is mounted.

In this embodiment of the intake manifold 3, the right and left outer branch tubes 4, 4 on the side of the plenum chamber 5 are integrally formed with respective flat portions 8, 8 projecting laterally.

The flat portions 8 are provided in order that the intake manifold 3 can be provisionally placed by placing the flat portions 8 on a bracket 19 that may be previously mounted by bolts 17 on the right and left fixed portions 2*a*, 2*a* formed on the top surface of the rocker cover 2.

Thus, since the plenum chamber portion 5 and the throttle chamber mounting flange 6 of the intake manifold 3 are heavy in the weight, it is desirable to place those members 5, 6 provisionally during the mounting operation of the intake manifold 3. For this purpose, the flat portions 8 are placed provisionally on the brackets 19, and after that those members 8 and 19 are fixed with bolts 18.

Figure 4:
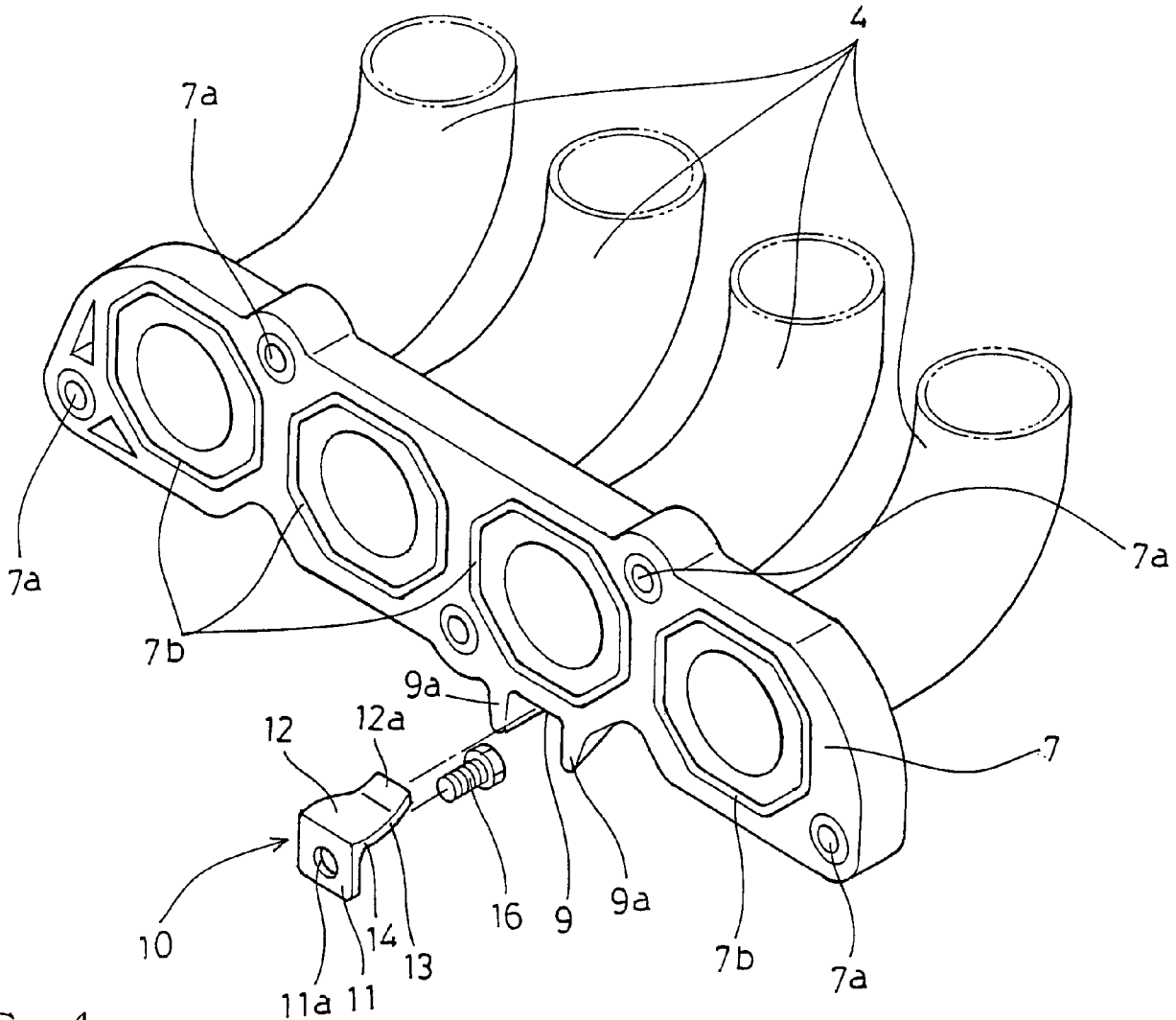
FIG. 4 is an enlarged, exploded perspective view of the joining surface of a flange of the intake manifold and a retainer to be fixed on the cylinder head.

FIG. 4 is an enlarged perspective view of the joining surface of the flange 7 on the side of the intake manifold 3. A plurality of fitting-bolt holes 7*a*, 7*a*, 7*a* are formed in the flange 7 in order to receive bolts 15. Also, O-ring grooves 7*b*, 7*b* are formed to receive O-rings. Further, in this embodiment, an engaging recess 9 is formed in the lower portion of the flange 7. The engaging recess 9 is provided with protruded portions 9*a*, 9*a* protruding downward on the right and left ends of the recess 9. Those protruded portions 9*a*, 9*a* define the engaging recess 9 to extend upward from the lower edge of the flange 7.

On the other hand, a retainer 10 is fixed with a fitting bolt 16 to the lower end of a flange 1*a* of the cylinder head 1.

Figure 5:
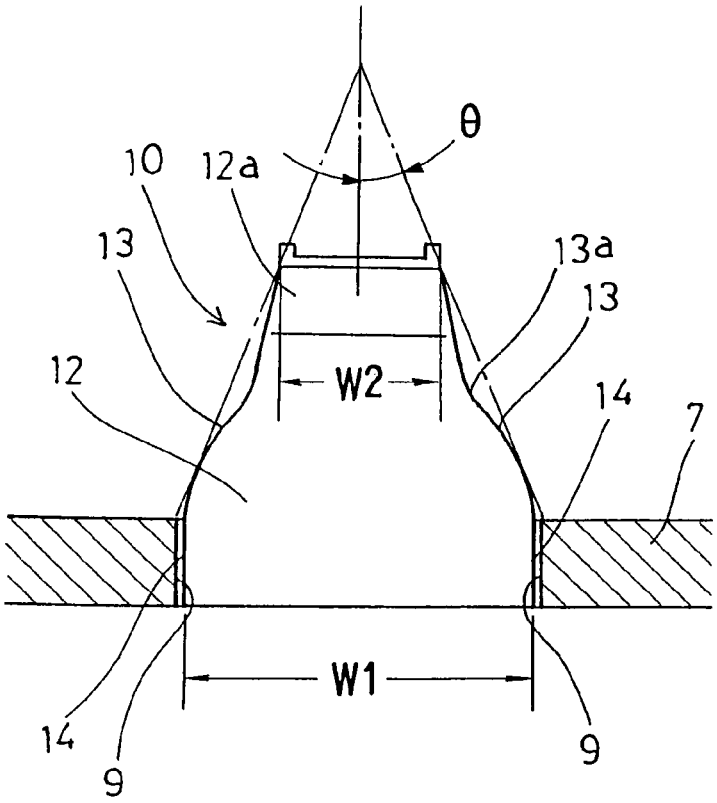
FIG. 5 is an enlarged plan view of the retainer completely fitted in an engaging recess of the flange.
Figure 6:
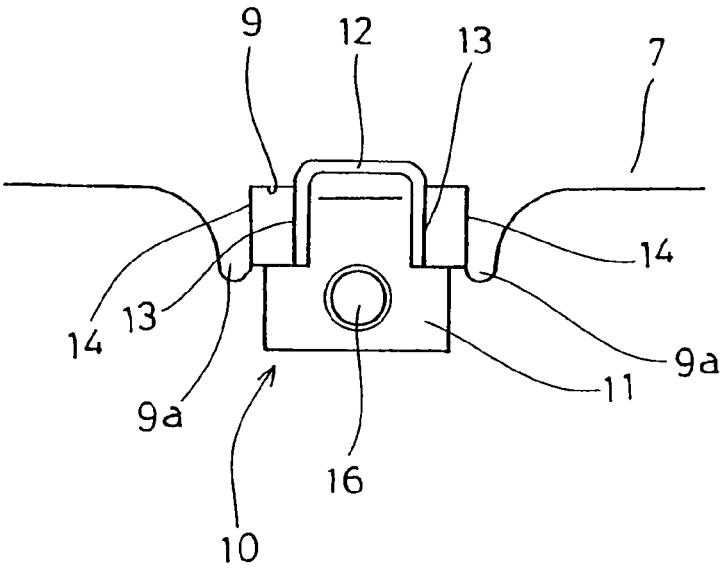
FIG. 6 is a front view of the retainer fitted in the engaging recess of the flange.

The retainer 10 is formed to have a configuration as shown by the perspective view in FIG. 4, by the enlarged plan view in FIG. 5 and by the front view in FIG. 6 in the mounted condition.

Thus, the retainer 10 is fixed to the cylinder head 1 by a vertical mounting arm 11 that has a bolt hole 11*a* formed therethrough for permitting insertion of a fitting bolt 16. The retainer 10 has an horizontal projecting arm 12 formed integrally with the retainer 10 and extending outwardly from the upper end of the mounting arm 11.

The projecting arm 12 is formed to extend substantially in a horizontal plane at the base (on the side of the mounting arm 11) and the side surfaces are tapered toward the tip end to narrow the width toward the tip end. The tip end is formed as an upwardly inclined end portion 12*a*. The width W2 of this upwardly inclined end portion 12*a* is set to be about ½ to ⅓ of the width W1 of the base portion. The taper angle θ is set to be equal to or less than 45°.

The tapered side surfaces extending from the base to the upwardly inclined end portion 12*a* are integrally bent downward for ensuring strength. Further, the tapered side surfaces serve as guiding side surfaces 13, 13 when the engaging recess 9 formed in the flange 7 is engaged. Incidentally, the right and left guiding side surfaces 13, 13 may be formed along a straight line or a curved line 13*a* as shown in FIG. 5.

On the other hand, the side surfaces on the side of the base of the projecting arm 12 form positioning side surfaces 14, 14 parallel between the right and left sides. The positioning side surfaces 14 are sized to provide a clearance of 0.2 mm to 1 mm when fitted in the engaging recess 9 formed in the flange 7.

The engaging recess 9 of the flange 7 of the intake manifold 3 may be provisionally placed on the upwardly inclined end portion 12*a* of the projecting arm 12, and then the flange 7 may be gradually moved toward the cylinder head or toward the base of the projecting arm 12. At this time, the right and left guiding side surfaces 13, 13 may well help the movement.

When the flange 7 arrives at the base portion of the projecting arm 12, the positioning side surfaces 14, 14 may be well fitted in the engaging recess 9. In this condition, it is set such that the bolt holes of the cylinder head 1 align with the bolt holes 7*a* of the flange 7.

Incidentally, although the base portion of the projecting arm 12 extends outwardly and horizontally and the tip end portion is inclined upward to form the upwardly inclined end portion 12*a*, the entire portion of the projecting arm may be inclined upward from the base to the tip end.

Accordingly, when the intake manifold 3 is mounted in this embodiment, the flange 7 is provisionally placed on the tip end of the projecting arm 12 of the retainer 10 and also the flat portions 8 are provisionally placed on the brackets 19, and then the flange 7 is slid to the side of the cylinder head 1 for positioning with the flange 7 kept to be placed on the projecting arm 12. Therefore, the positioning operation can be properly performed, so that the tightening and fixing operations of the fitting bolts 15 can be easily performed without causing the O-rings to be dropped out of the O-ring grooves 7*b*, 7*b*, 7*b*. Besides, it is possible to secure good sealing.

Moreover, it is not necessary to use the conventional stud bolts, so that it is possible to reduce the number of part items. Further, since the retainer 10 does not require long outward projection like the conventional stud bolt, it is possible to decrease the moving distance of the flange 7 to the side of the cylinder head 1, so that it is possible to increase the number of degrees of arrangement freedom for the plenum chamber 5, throttle chamber mounting flange 6, and the like.

Figure 7:
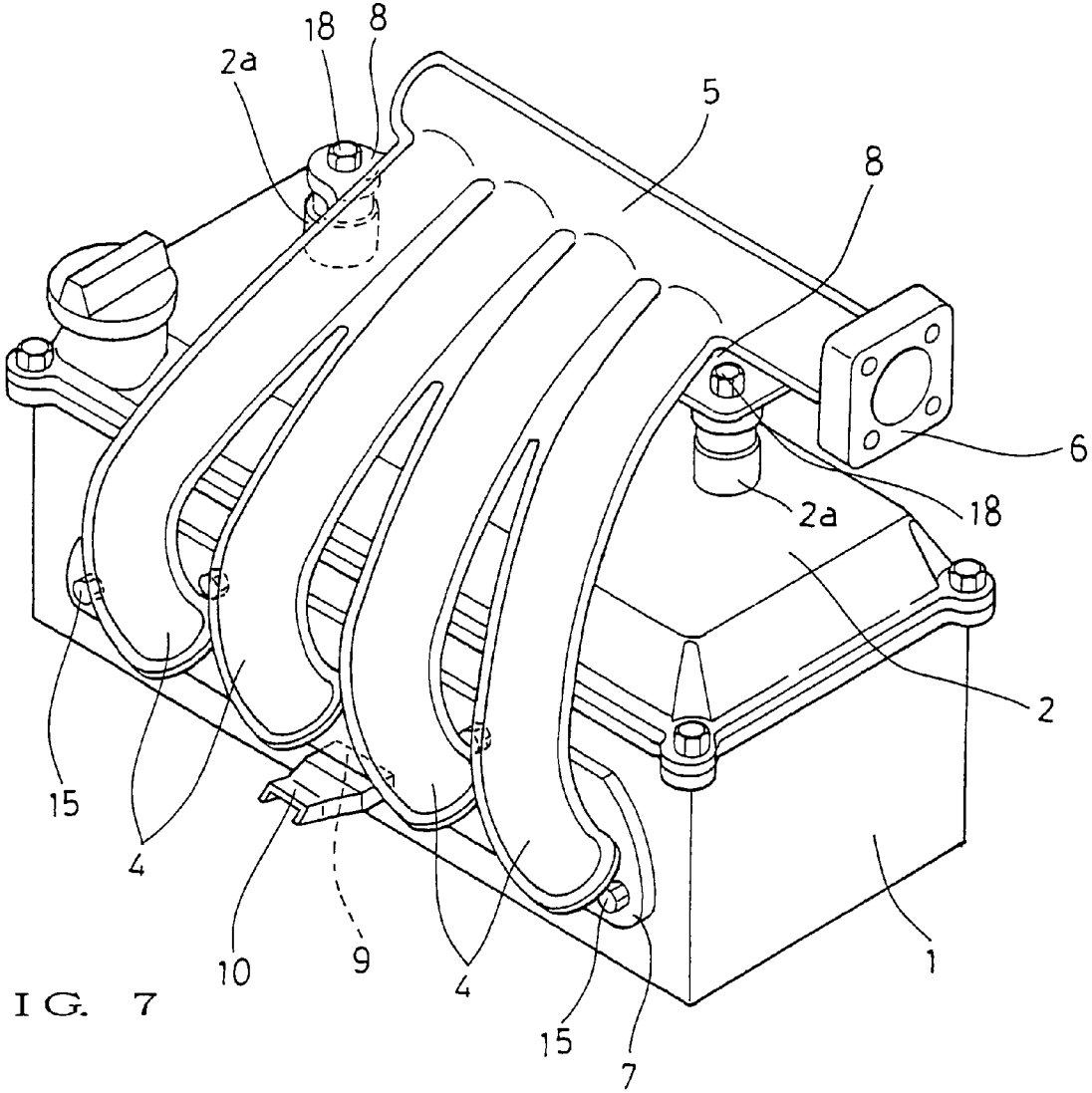
FIG. 7 is a perspective view of a mounting structure of an intake manifold where a rocker cover is formed integrally with fixed portions.
Figure 8:
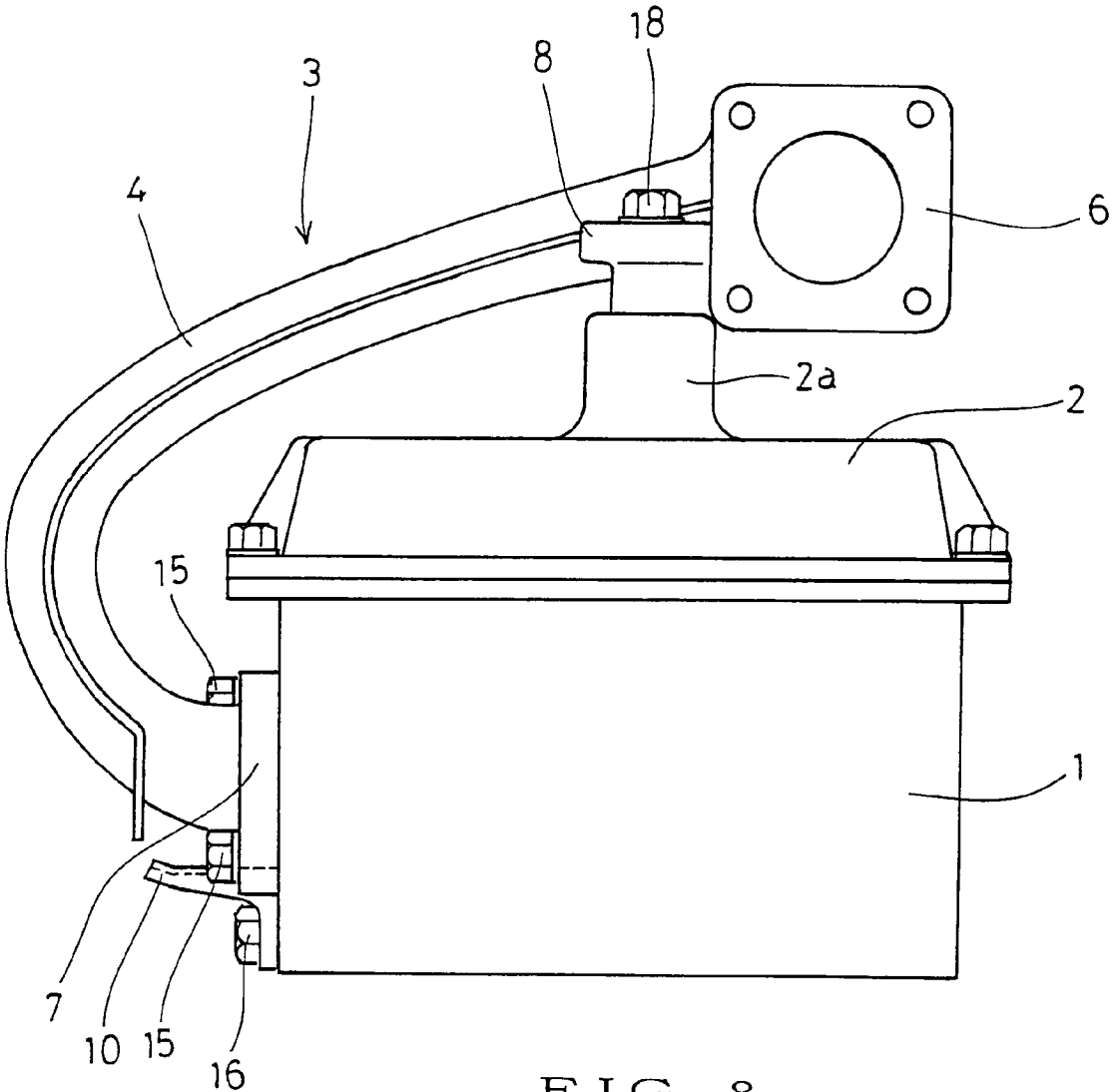
FIG. 8 is a side view of FIG. 7.

Next, alternative embodiment is shown by the perspective view in FIG. 7 and by the side view in FIG. 8. In this embodiment, the top of the rocker cover 2 is provided with fixed portions 2*a*, 2*a* that are integrally protruded upward. Those fixed portions 2*a*, 2*a* are adapted to place the flat portions 8 thereon for provisionally fixing in position.

With this arrangement, the brackets 19 are no longer necessary by integrally forming the fixed portions 2*a* with the rocker cover 2, so that the number of part items is decreased.

Figure 9:
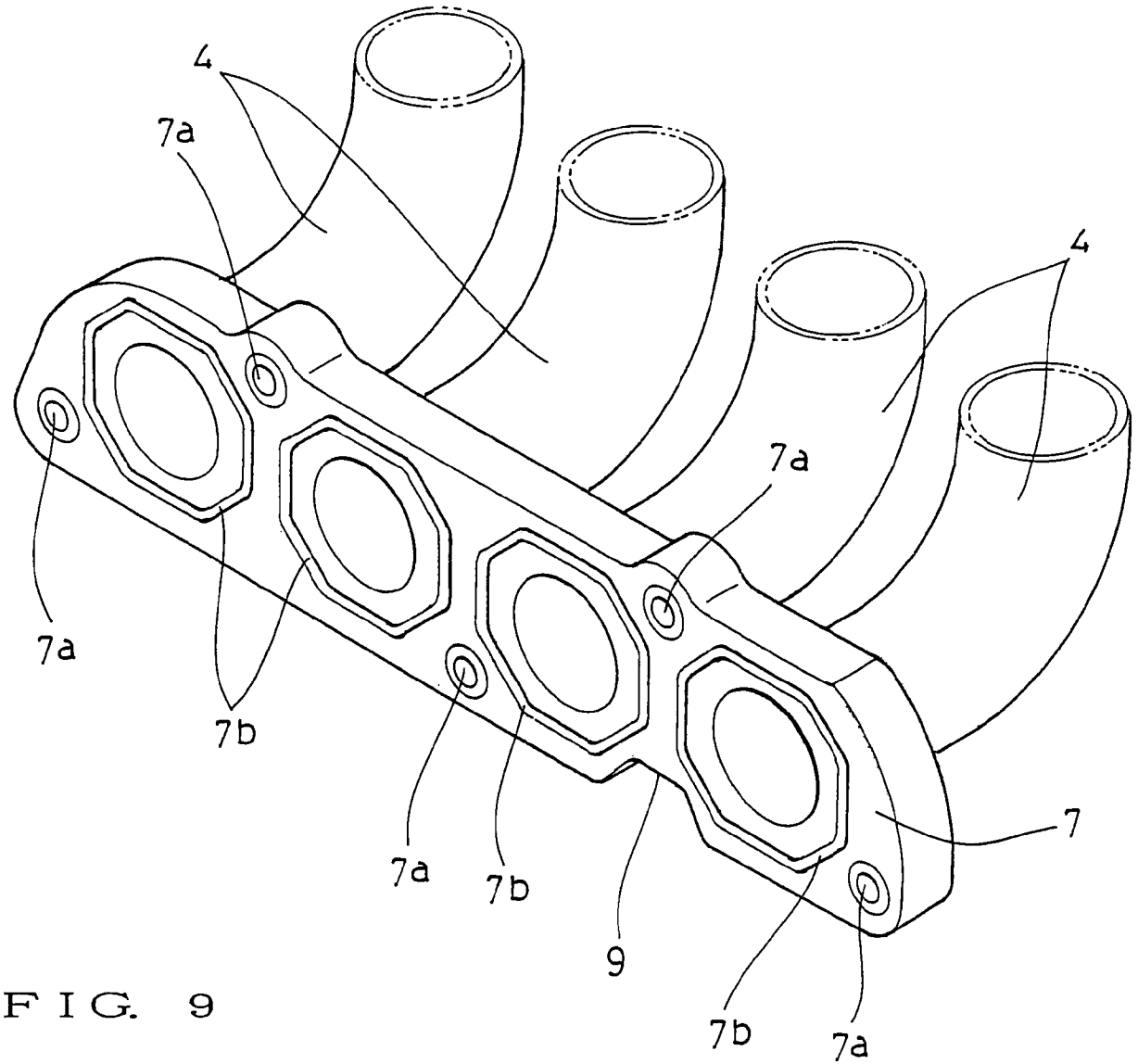
FIG. 9 is an enlarged perspective view of a main portion of a modified engaging recess of the flange.

FIG. 9 shows a modification of the engaging recess 9.

This engaging recess 9 is formed in such way that the lower edge of the flange 7 extends along a straight line and a hollow section is formed to extend upward from the lower edge. Namely, this engaging recess 9 can be made without the protruded portions 9*a* in FIG. 4.

The engaging recess 9 may be formed in another location than the central portion with respect to right and left directions of the flange 7. Also on the side of the cylinder head 1, retainers 10, 10 may be provided in alignment with engaging recesses 9. Accordingly, on the condition that each engaging recess 9 is provisionally placed on the retainer 10, the flange 7 can be moved toward the cylinder head 1 for positioning.

Figure 10:
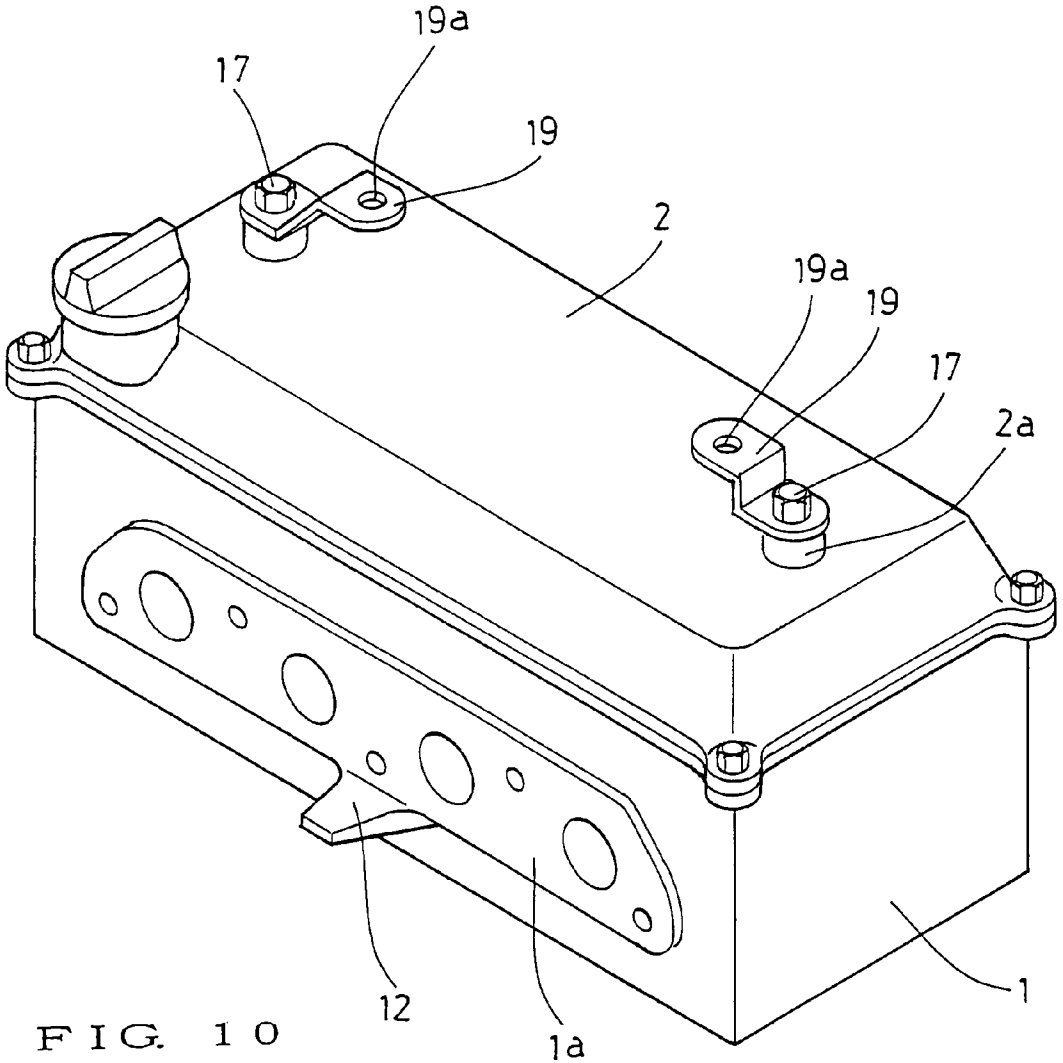
FIG. 10 is a perspective view of a cylinder head where a projecting arm is integrally formed on a flange of the cylinder head.
Figure 11:
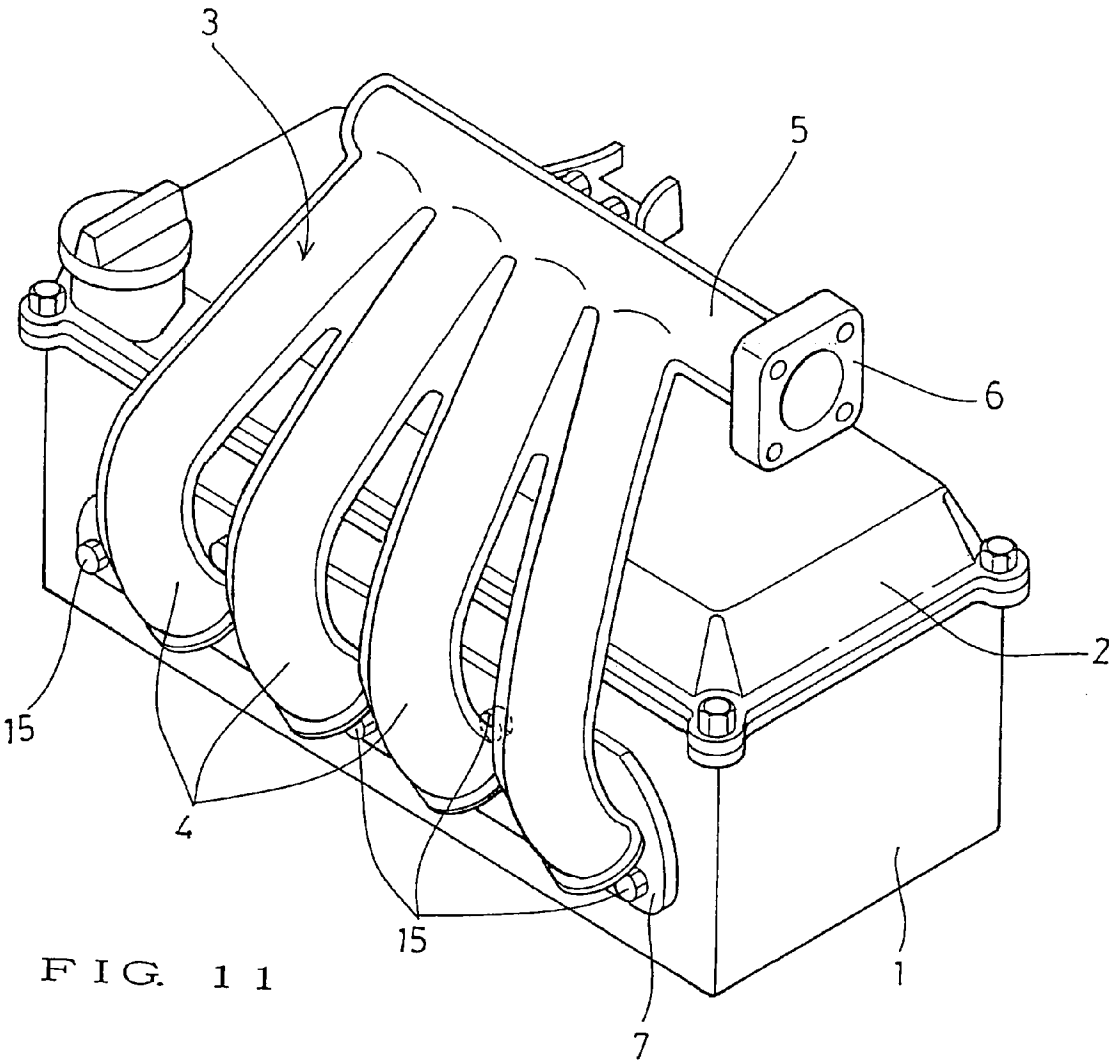
FIG. 11 PRIOR ART
FIG. 11 is a perspective view of a conventional mounting structure of an intake manifold.
Figure 12:
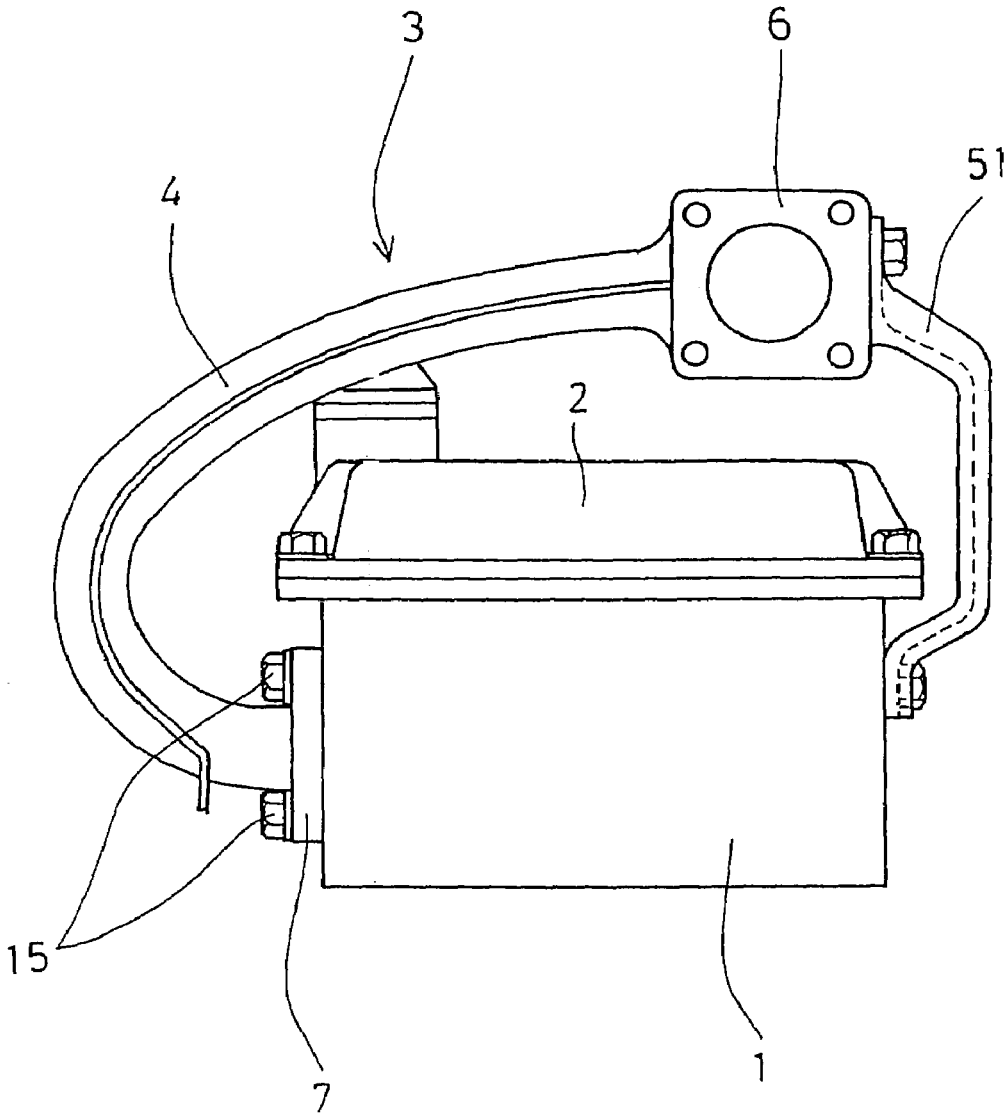
FIG. 12 PRIOR ART
FIG. 12 is a side view of FIG. 11.
Figure 13:
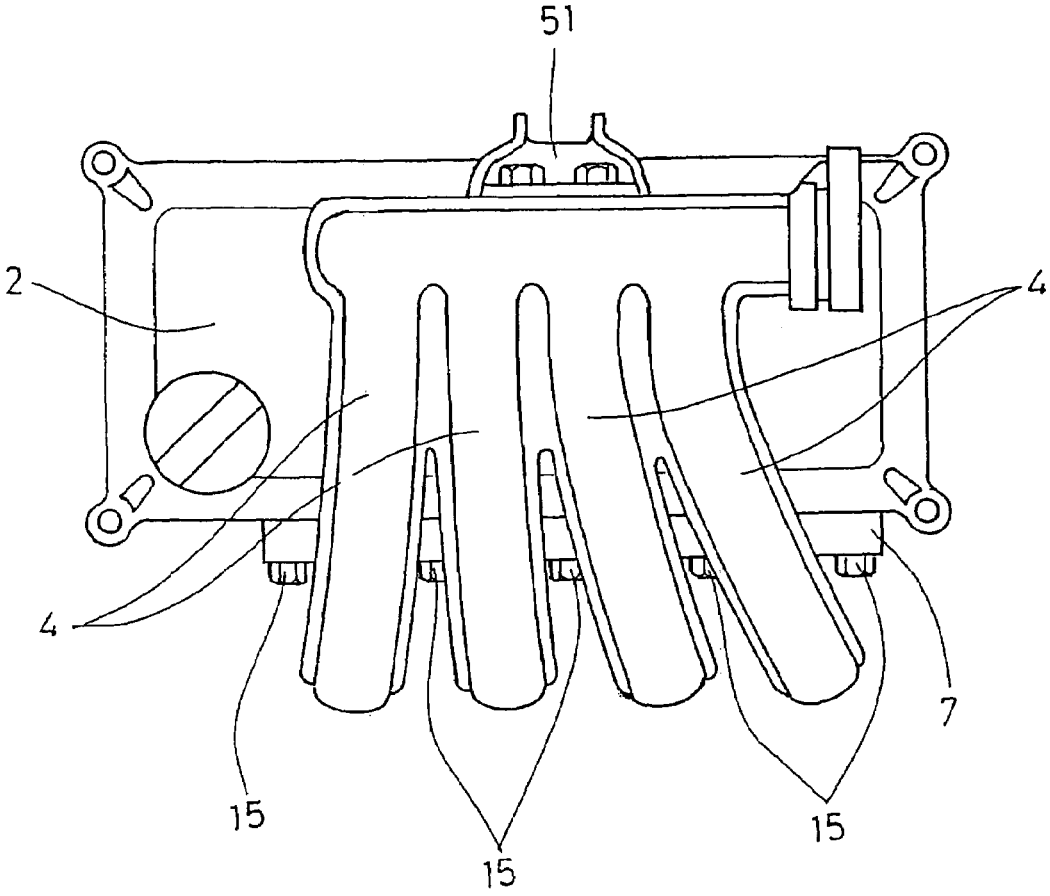
FIG. 13 PRIOR ART
FIG. 13 is a plan view of FIG. 11.
Figure 14:
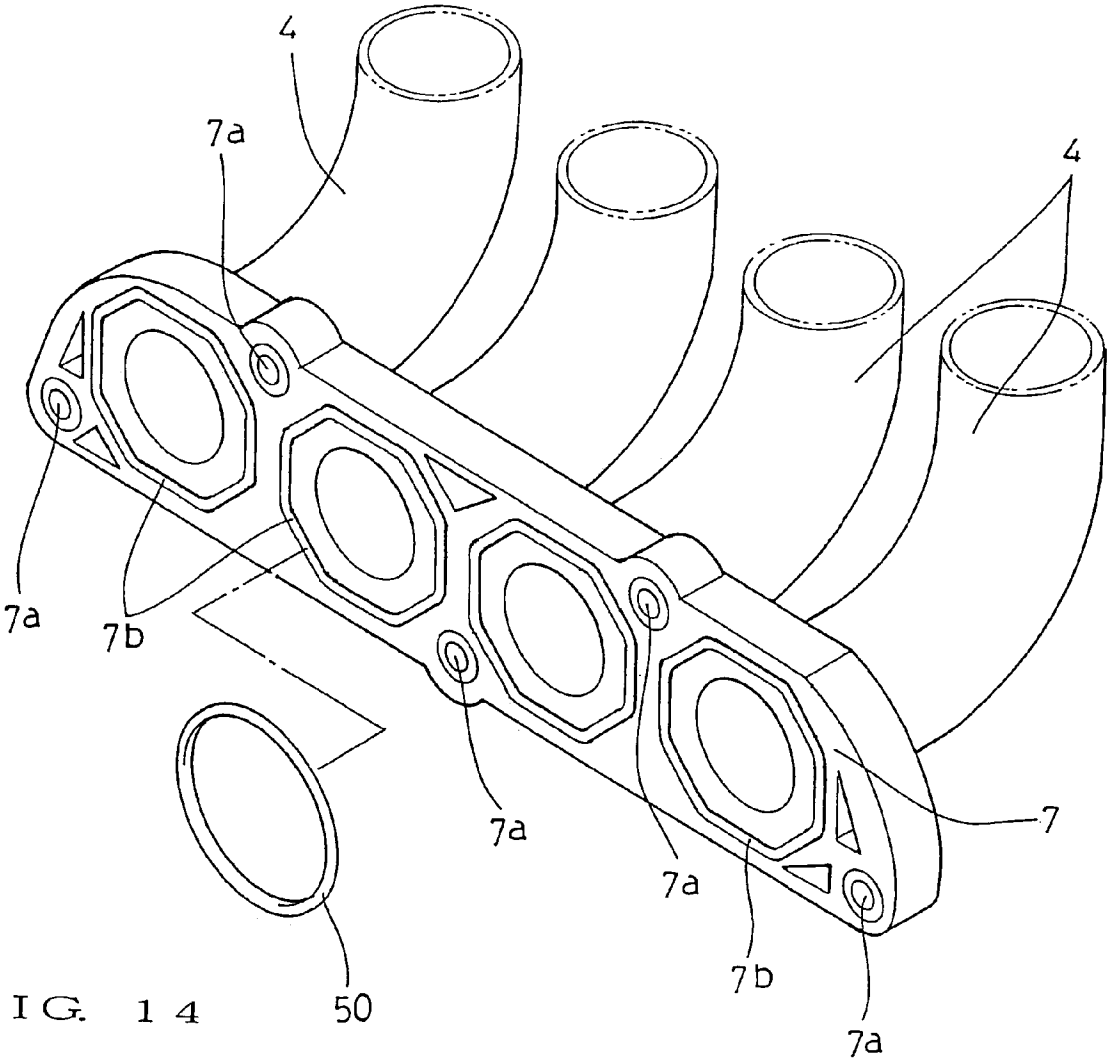
FIG. 14 PRIOR ART
FIG. 14 is an enlarged perspective view of a main portion of a conventional construction and showing the state where O-rings are fitted into O-ring grooves formed in a flange.
Figure 15:
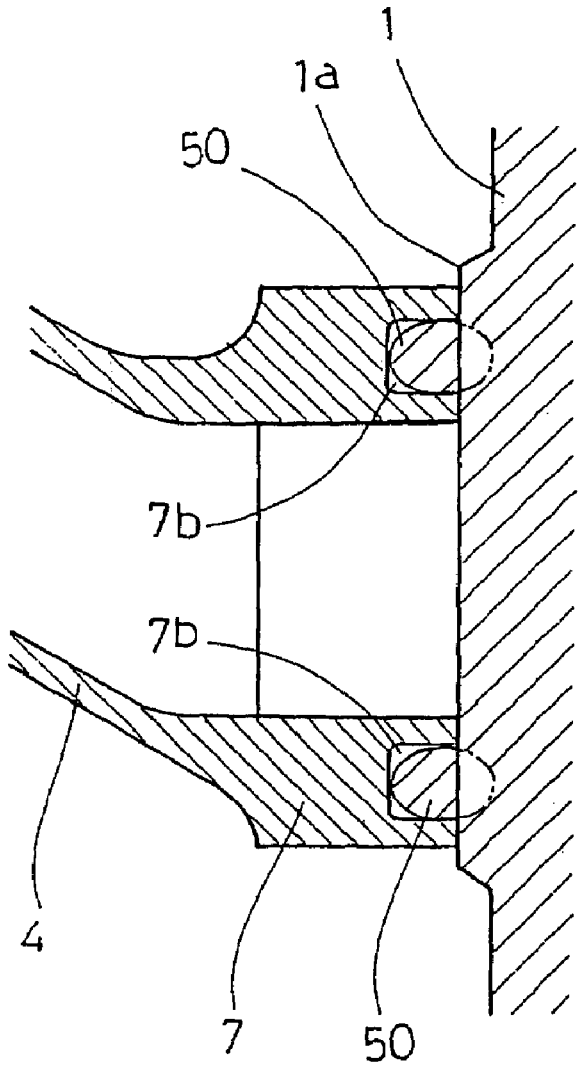
FIG. 15 PRIOR ART
FIG. 15 is a sectional view of a main portion of a mounting structure showing mounted condition of O-rings.
Figure 16:
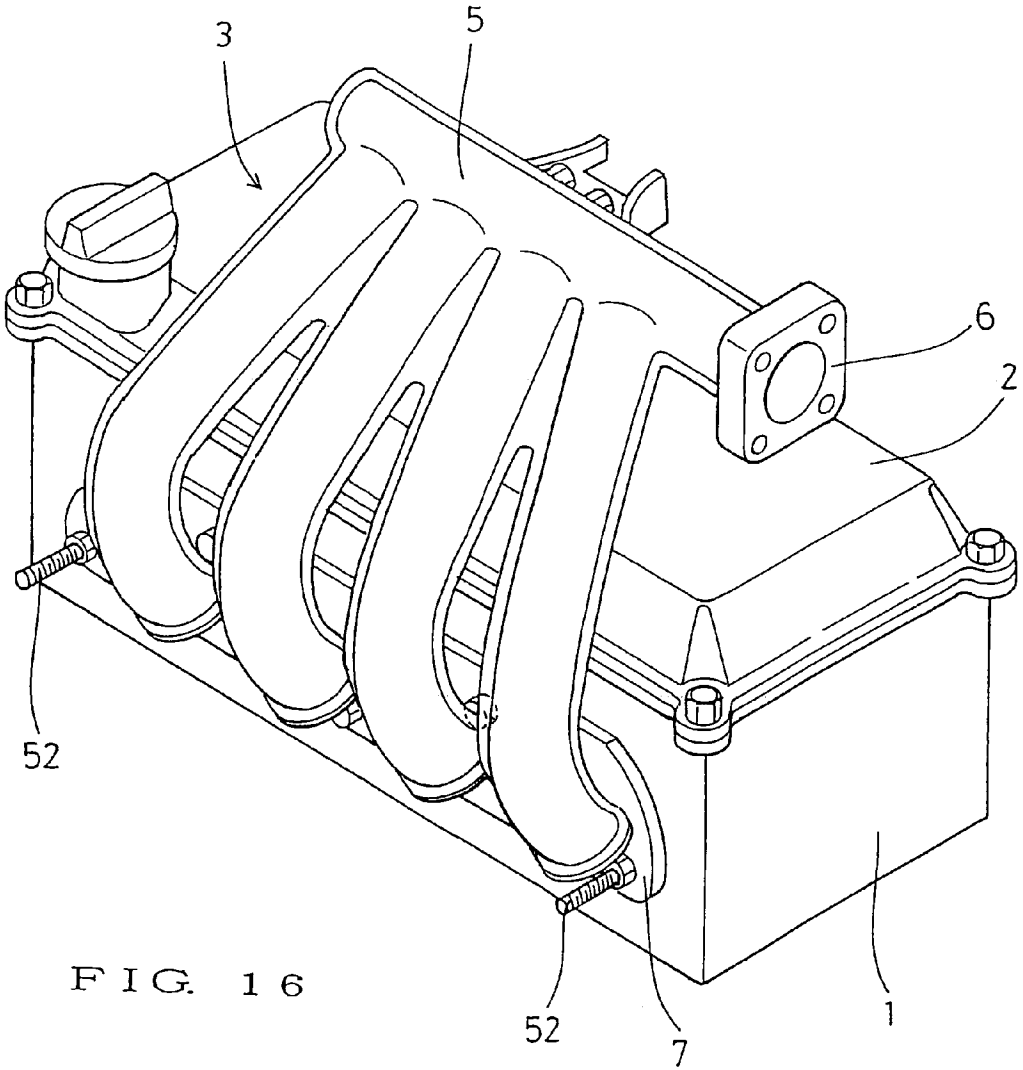
FIG. 16 PRIOR ART
FIG. 16 is a perspective view of a mounting structure of an intake manifold where stud bolts are provided.
Figure 17:
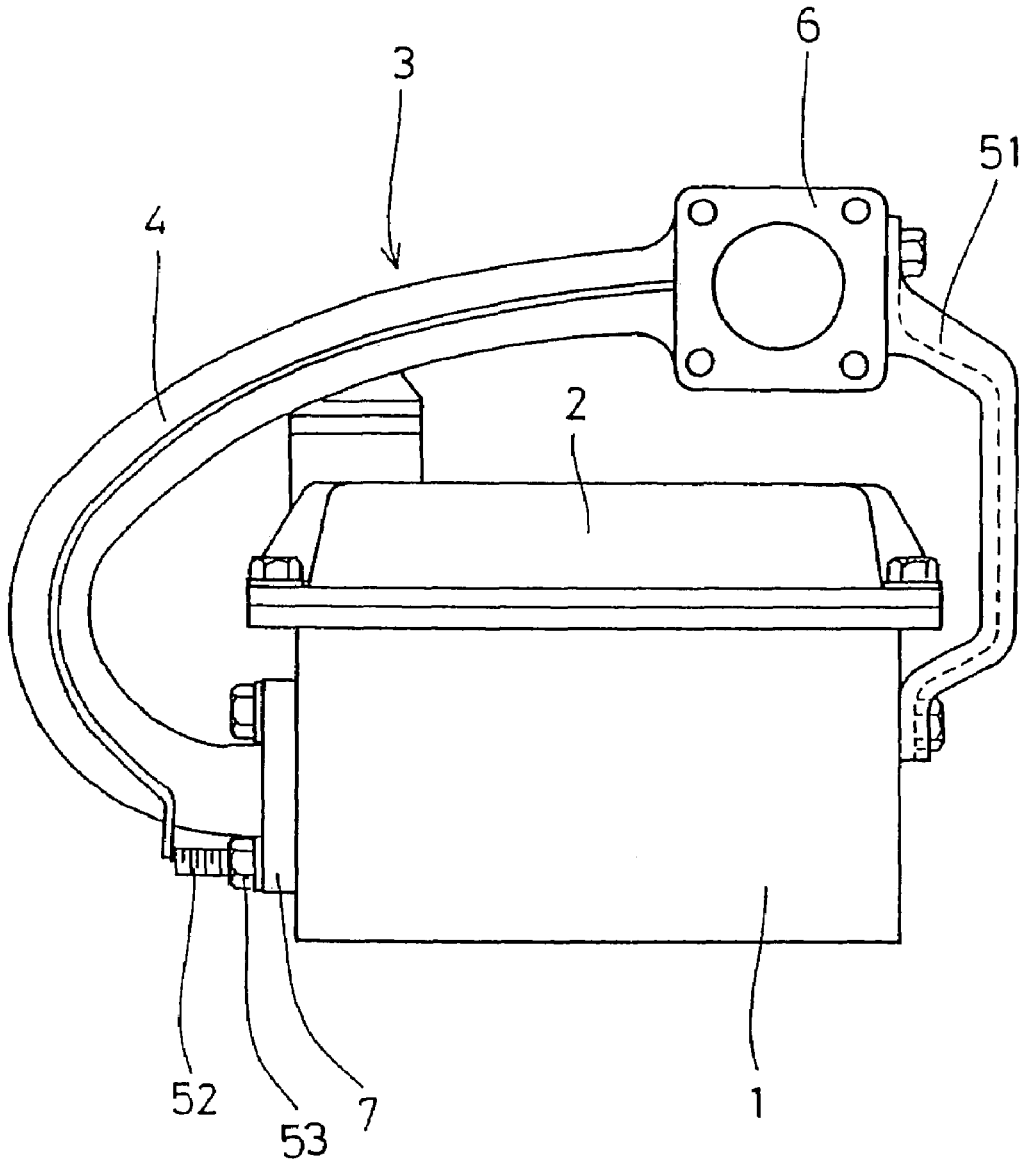
FIG. 17 PRIOR ART
FIG. 17 is a side view of FIG. 16.
Figure 18:
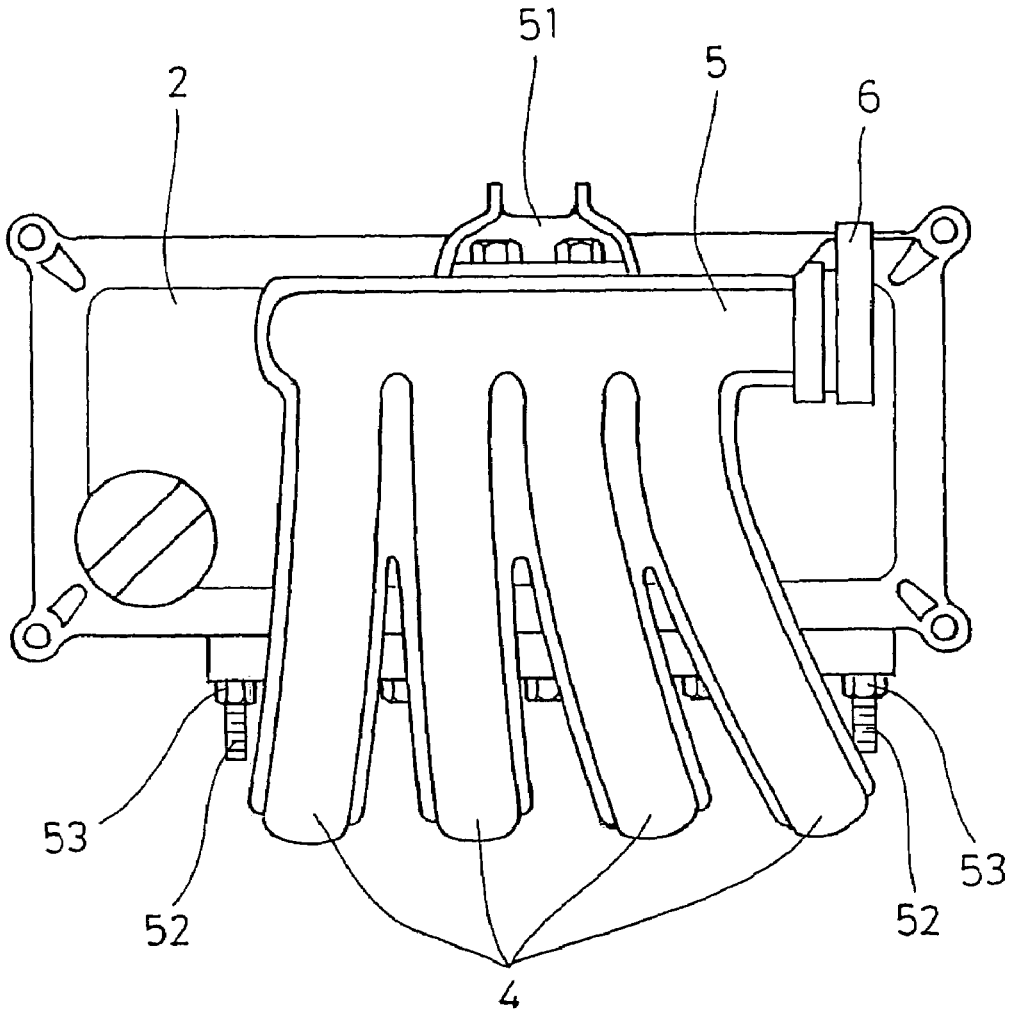
FIG. 18 PRIOR ART
FIG. 18 is a plan view of FIG. 16.
Figure 19:
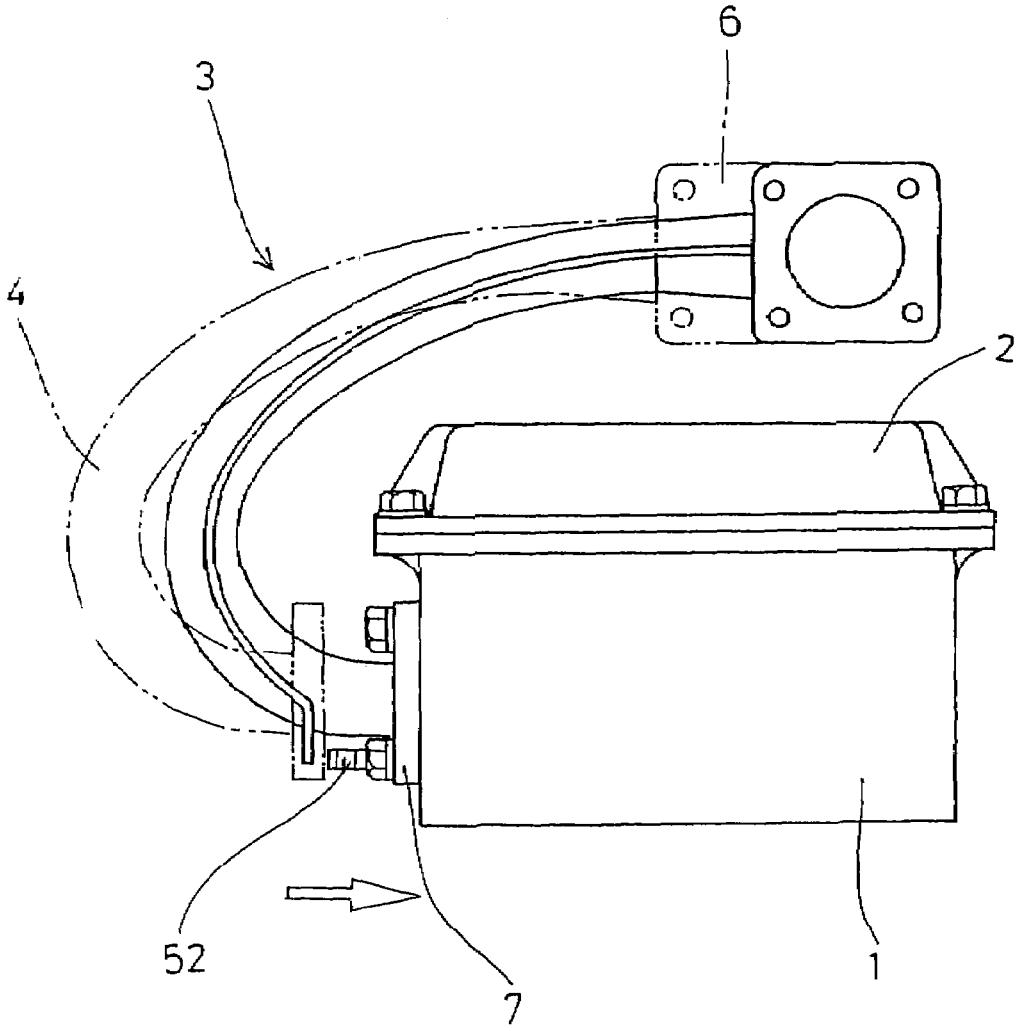
FIG. 19 PRIOR ART
FIG. 19 is an illustration of a mounting operation of an intake manifold by moving a flange relative to a stud bolt.
Figure 20:
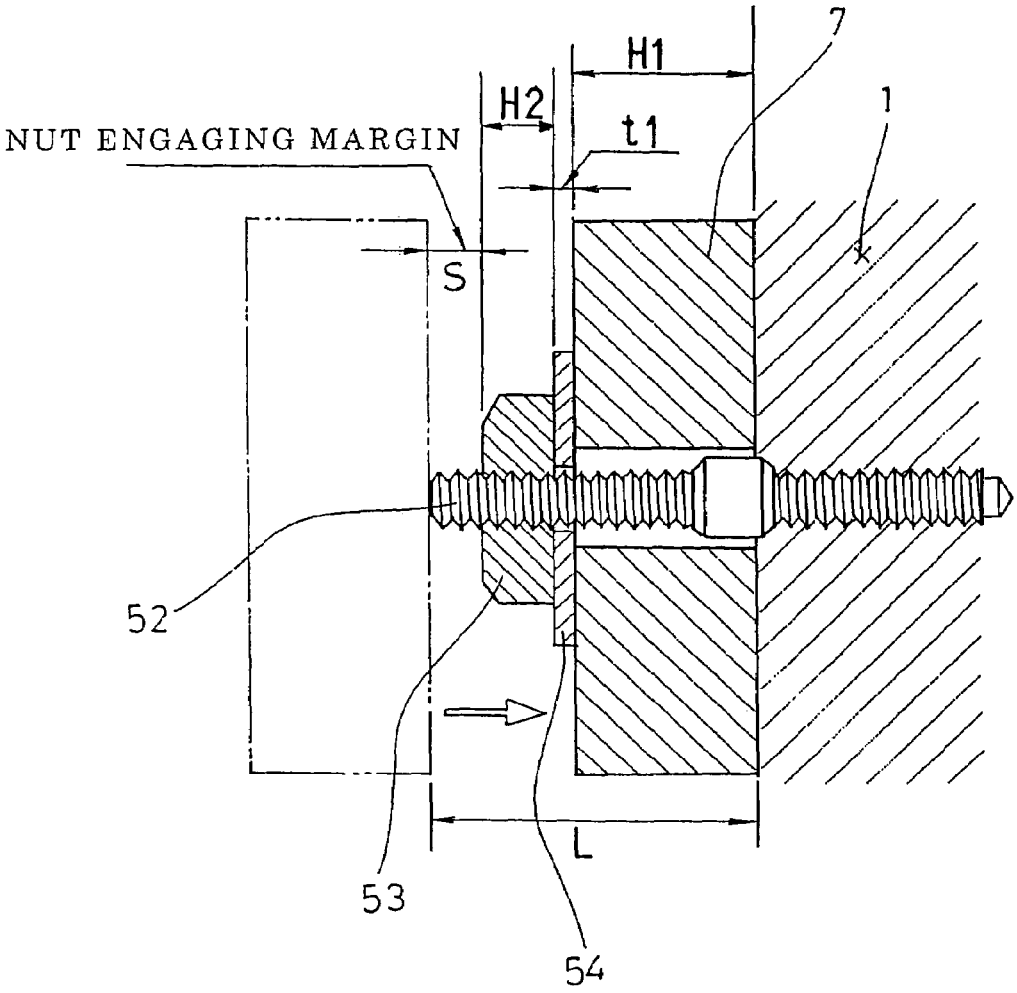
FIG. 20 PRIOR ART
FIG. 20 is an enlarged sectional view of a stud bolt.
Figure 21:
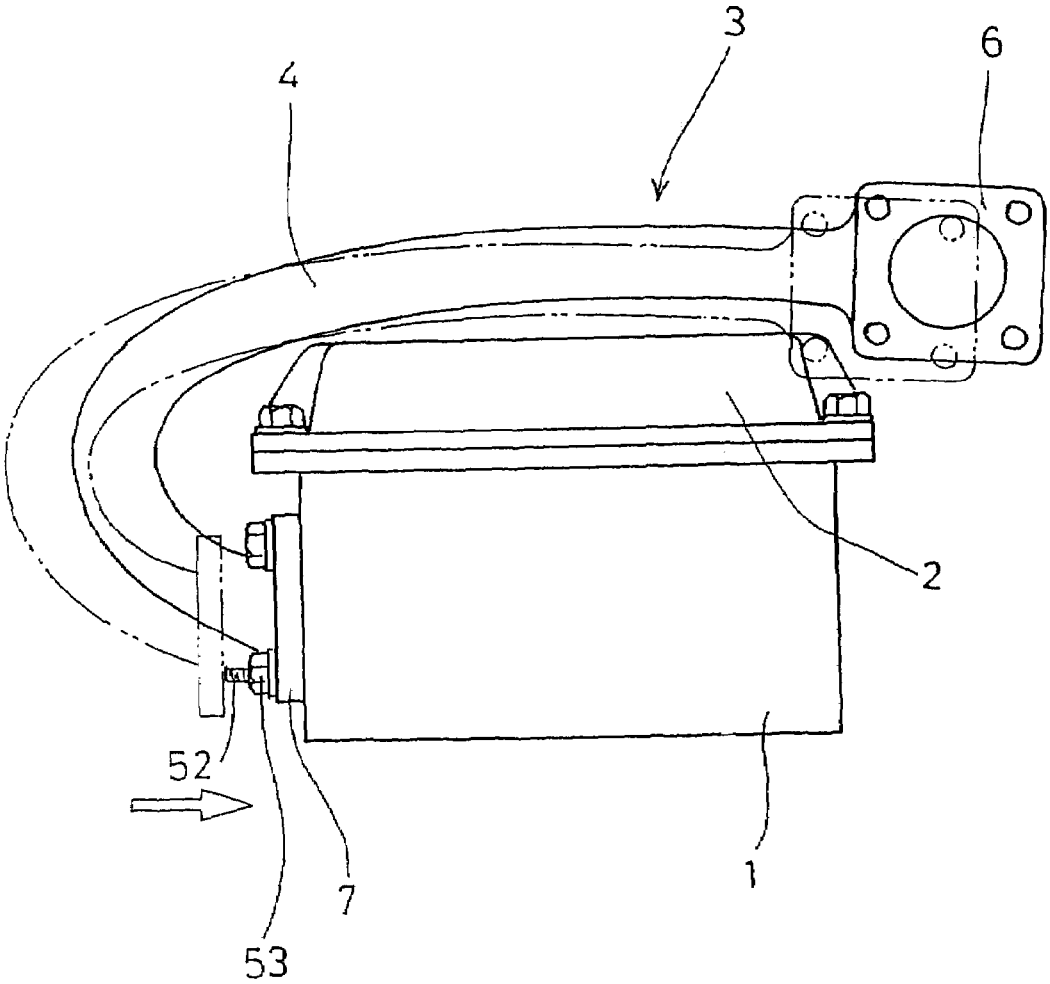
FIG. 21 PRIOR ART
FIG. 21 is an illustration of the mounting operation where an intake manifold is in contact with the top of a rocker cover.
Figure 22:
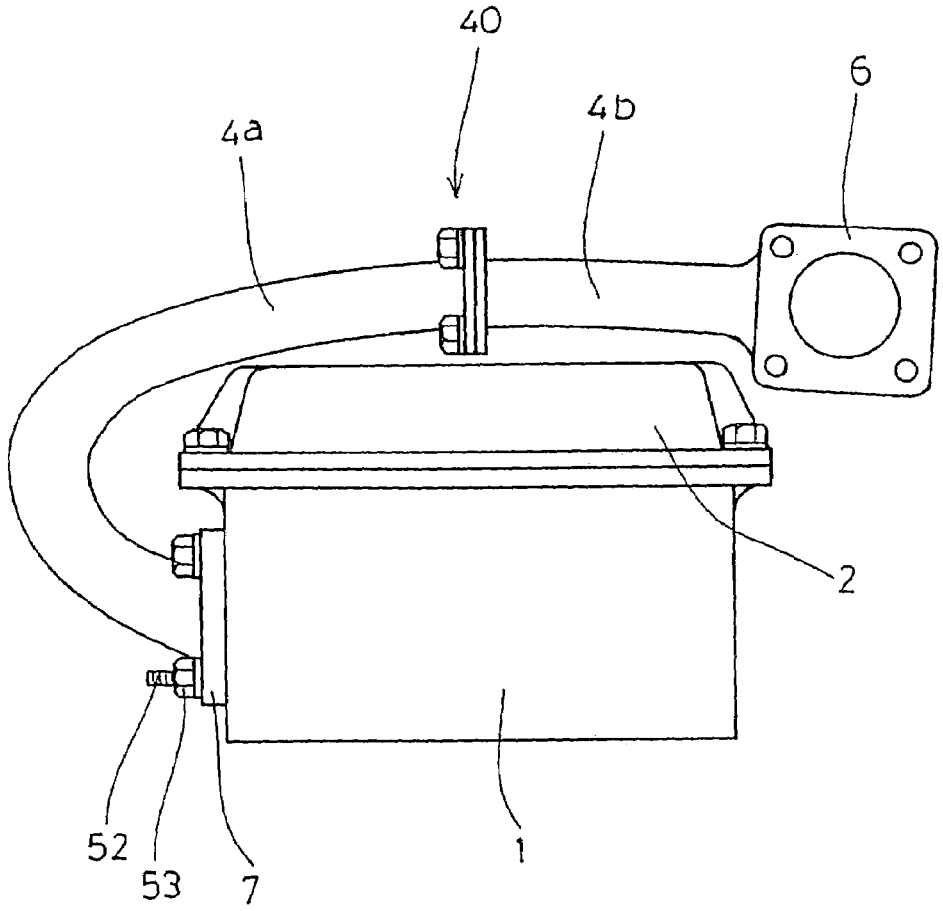
FIG. 22 PRIOR ART
FIG. 22 is a side view of the branch tubes formed in a divided structure.

Further, FIG. 10 shows a modification in which the projecting arm 12 integrally outwardly projecting is formed on the central portion of the lower end of the flange 1*a* that is integrally formed on the cylinder head 1. The projecting arm 12 may be formed integrally to have a structure as shown by the plan view in FIG. 5.

The invention claimed is:

1. A mounting structure of an intake manifold having a plurality of branch tubes arranged over a top surface of a cylinder head in a state where a flange provided at downstream-side ends of said branch tubes is fixed to a lateral surface of the cylinder head, and having a plenum chamber portion provided at upstream-side ends of said branch tubes; comprising:

a projecting arm provided on the lateral surface of the cylinder head and projecting outward therefrom; and an engaging recess provided in a lower portion of said flange of the intake manifold in order to engage with said projecting arm.

2. A mounting structure of an intake manifold as defined in claim 1, wherein said projecting arm is formed to be tapered from a tip end narrower than said engaging recess to a wide base portion for engaging with said engaging recess.

3. A mounting structure of an intake manifold as defined in claim 2, wherein the tip end of said projecting arm is formed to be inclined upward.

4. A mounting structure of an intake manifold as defined in claim 3, wherein said plenum chamber portion of said branch tubes is provided with flat portions adapted to be provisionally placed on and fixed in position to the top surface of the cylinder head.

5. A mounting structure of an intake manifold as defined in claim 2, wherein said plenum chamber portion of said branch tubes is provided with flat portions adapted to be provisionally placed on and fixed in position to the top surface of the cylinder head.

6. A mounting structure of an intake manifold as defined in claim 1, wherein said plenum chamber portion of said branch tubes is provided with flat portions adapted to be provisionally placed on and fixed in position to the top surface of the cylinder head.

* * * * *